US011126131B2

(12) United States Patent
Nishida et al.

(10) Patent No.: US 11,126,131 B2
(45) Date of Patent: Sep. 21, 2021

(54) CLEANING DEVICE AND IMAGE FORMING APPARATUS

(71) Applicant: Konica Minolta, Inc., Tokyo (JP)

(72) Inventors: Satoshi Nishida, Saitama (JP); Tomo Kitada, Yokohama (JP); Takeshi Maeyama, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/924,159

(22) Filed: Jul. 8, 2020

(65) Prior Publication Data

US 2021/0063942 A1 Mar. 4, 2021

(30) Foreign Application Priority Data

Sep. 3, 2019 (JP) ..... JP2019-160478

(51) Int. Cl.
*G03G 21/00* (2006.01)
*G03G 15/16* (2006.01)

(52) U.S. Cl.
CPC ..... *G03G 21/0017* (2013.01); *G03G 15/161* (2013.01); *G03G 2221/0005* (2013.01)

(58) Field of Classification Search
CPC ..... G03G 15/161; G03G 21/0011; G03G 21/0017; G03G 2215/1647; G03G 2215/1661; G03G 2221/0005; G03G 2221/0068; G03G 2221/0089
See application file for complete search history.

(56) References Cited

U.S. PATENT DOCUMENTS 5,298,953 A * 3/1994 Lindblad ..... G03G 15/168 399/101
2011/0085834 A1* 4/2011 Naruse ..... G03G 21/0035 399/350
2013/0189012 A1* 7/2013 Sakon ..... G03G 21/0017 399/350
2017/0052491 A1* 2/2017 Hirota ..... G03G 15/5058
2017/0329274 A1* 11/2017 Meguro ..... G03G 15/161
2018/0356752 A1 12/2018 Kawanago

FOREIGN PATENT DOCUMENTS

JP 2003-058006 A 2/2003
JP 2018-205653 A 12/2018

* cited by examiner

*Primary Examiner* — Thomas S Giampaolo, II

(74) *Attorney, Agent, or Firm* — Squire Patton Boggs (US) LLP

(57) ABSTRACT

A cleaning device includes a thin plate-shaped first blade that cleans a surface of a toner carrying body by making a tip portion come in contact with the toner carrying body to carry toner. The first blade includes a substrate and a coat layer covering a surface of the substrate. In the first blade, a cross-sectional shape, in a thickness direction, of the tip portion is a convex shape, or a protruding shape in which a center side protrudes more than an end portion of a contact side.

9 Claims, 7 Drawing Sheets

FIG.3

| | | | |
|---|---|---|---|
| Secondary transfer belt (341) | | Material | Resin belt (PI) |
| | | Thickness | 100μm |
| | | Resistivity | 10logΩ·μm |
| Secondary transfer roller (r41) | | Outer diameter | ϕ 30mm |
| | | Material | SUS |
| | | Pressing force | 70N |
| Secondary transfer opposing roller (r21) | | Outer diameter | ϕ 30mm |
| | | Material | NBR |
| | | Hardness | 40° |
| | | Resistivity | 8logΩ |
| Secondary transfer cleaning device (35) | Elastic blade (352) | Material quality | Urethane |
| | | Contact angle | 15° |
| | | Contact pressure | 30N/m |
| | Rigid blade (351) | Material quality | SUS304+DLC coat |
| | | Thickness | 0.1mm |
| | | Free length | 10mm |
| | | Contact angle | 10° |
| | | Contact pressure | 5N |
| | | Amount of bite | 0.3mm |
| Lubricant coater (354) | Coating brush (54a) | Material quality | Polyester |
| | | Density | 150KF/inch$^2$ |
| | | Pile diameter | 4d |
| | | Resistivity | 10^12 |
| | | Outer diameter | ϕ 12mm |
| | | Core metal diameter | ϕ 6mm |
| | | Amount of bite | 0.5mm |
| | Lubricant (54b) | Material quality | ZnSt |
| | | Shape | H4.5 x W8.0mm |
| | | Pressing force | 1N |

FIG.9A
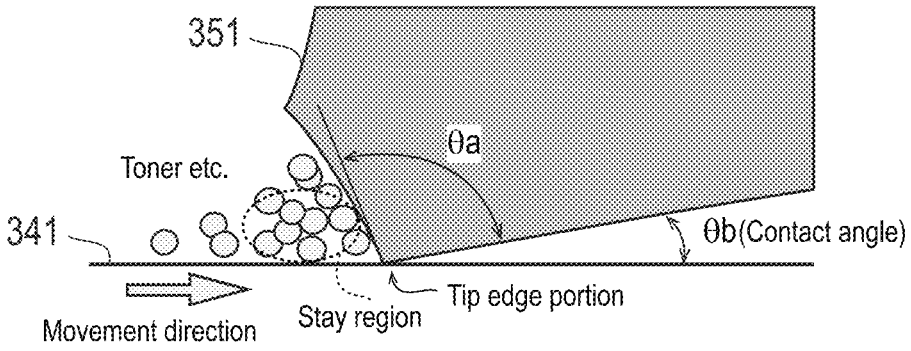
FIG.9B
| Tip edge angle on contact surface side θa(deg) | 160 | 150 | 140 | 130 | 120 | 110 | 100 | 90 | 80 | 70 | 60 | 50 | 40 |
|---|---|---|---|---|---|---|---|---|---|---|---|---|---|
| Toner compressed-contact slipping-through | C | C | B | A | A | A | A | A | A | A | A | A | A |
| Tip chipping / bending | A | A | A | A | A | A | A | A | A | A | B | C | C |
FIG.10
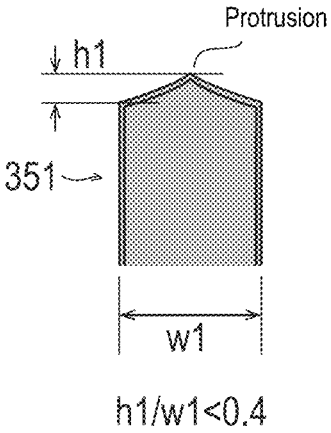

CLEANING DEVICE AND IMAGE FORMING APPARATUS

CROSS-REFERENCE TO RELATED APPLICATION

The entire disclosure of Japanese patent application No. 2019-160478, filed on Sep. 3, 2019, is incorporated herein by reference in its entirety.

BACKGROUND

1. Technical Field

The present invention relates to a cleaning device and an image forming apparatus.

2. Description of Related Arts

In recent years, in image forming apparatuses by an electrophotographying system, from the viewpoint of making image quality higher, making toner particle diameter smaller has been required. Accordingly, for example, toner particles manufactured by using polymerizing methods, such as an emulsion polymerization method and a suspension polymerization method, have been used.

Here, as a method of removing residual toner on an image carrying body, such as a photo conductor, after transferring a toner image, there is a method of scraping off toner particles by making a cleaning blade composed of a urethane rubber etc. come in contact with the image carrying body in a counter direction. However, since the adhesion force between toner particles and the image carrying body becomes larger in association with the making toner particle diameter smaller, it has been becoming difficult to remove residual toner on the image carrying body. In particular, in a cleaning blade having been used for a long period, a tip portion coming in contact with the image carrying body gets worn out. With this, a scraping-off force with the blade is lowered, cleaning failure so called "slipping through" in which toner slips through the blade, tends to occur. As a result, it becomes difficult to remove residual toner on the image carrying body.

From such situations, in Patent Literature 1 (JP 2003-058006A), it is tried to improve the cleaning performance by further providing a thin plate-shaped metal blade on the downstream side of the cleaning blade. Moreover, such a blade does not come in contact with the surface of an image carrying body (rotating body) in a state where an edge portion of a tip has elastically deformed, but the blade comes in contact in a state where an edge portion of a metal member is as it is. Accordingly, a matter to administrate the shape of a tip of the metal member in micron units, has been raised as an assignment. Furthermore, as a technique for the matter, in Patent Literature 1, by forming the thin plate-shaped metal member by an etching process, a cross-sectional shape, in the thickness direction, of a tip portion that comes in contact with the surface of an image carrying body, is made to form in a concave shape.

Moreover, In Patent Literature 2 (JP 2018-205653A), in order to maintain a cleaning performance for a long period, disclosed is a configuration in which a coat layer of a hard carbon film containing amorphous carbon, such as diamond like carbon (DLC) is provided on a surface relative to a cleaning blade.

SUMMARY

However, in the blade in Patent Literature 1, since the tip of the metal member being a substrate is formed in a concave shape, the edge of the tip has an acute angle. In the case where the coat layer disclosed in Patent Literature 2 is provided on a portion with such an acute angle, a region in which there is no substrate and exists only the coat layer, occurs on the tip portion. In the case where such a region frictionally slides with an image carrying body, the coat layer is partially peeled off, or bending occurs. As a result, it becomes impossible to try to maintain a cleaning performance for a long period that is the original purpose.

The present invention has been achieved in view of the above-described circumstances, and an object is to provide a cleaning device and image forming apparatus in which, in a blade provided with a coat layer, a cleaning performance is made high from an initial stage, and a durability has been improved so as to maintain the performance fora long time.

In order to realize the above-mentioned object, a cleaning device that reflects one aspect of the present invention, includes a thin plate-shaped first blade that makes a tip portion come in contact with a toner carrying body used to carry toner, thereby cleaning a surface of the toner carrying body, wherein the first blade includes a substrate and a coat layer covering a surface of the substrate; and in the first blade, a cross-sectional shape, in a thickness direction, of the tip portion is a convex shape, or a protruding shape in which a center side protrudes more than an end portion of a contact side.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

FIG. 3 is a table showing an example of a designed value of each structural member.

FIG. 9A is a schematic drawing showing an angle of a tip edge portion, FIG. 9B is a table of an evaluation result showing a proper range of an angle of a tip edge portion.

FIG. 10 is a schematic drawing for describing a ratio of a protruding length of a protrusion on a center side relative to a thickness of a blade.

DETAILED DESCRIPTION OF EMBODIMENTS

Figure 1:
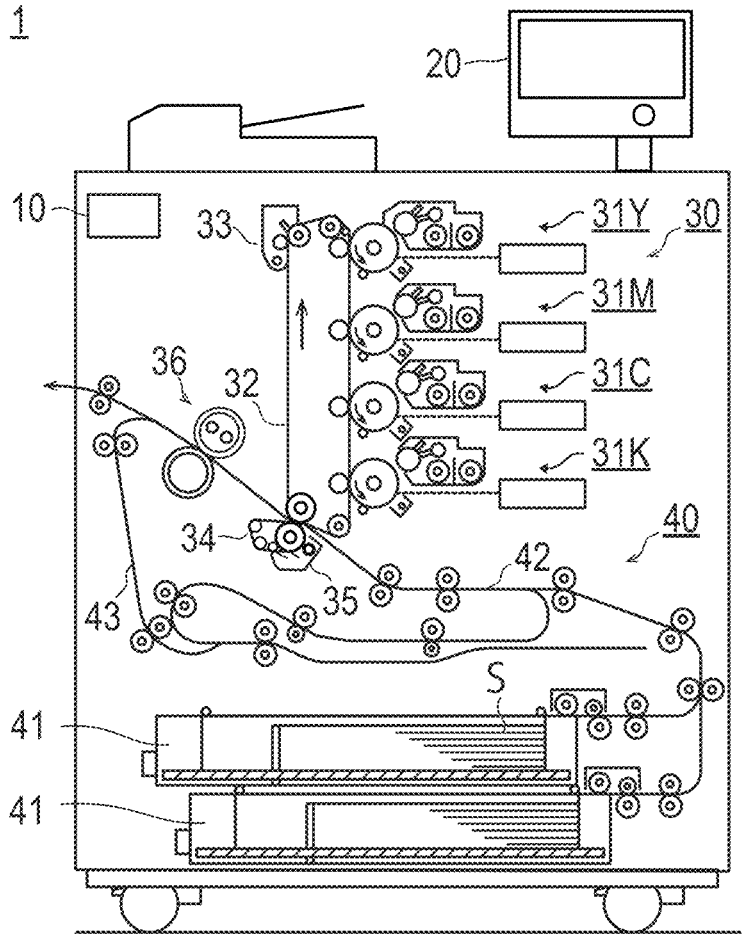
FIG. 1 is a drawing showing a schematic configuration of an image forming apparatus according to the present embodiment.

Hereinafter, with reference to attached drawings, an embodiment of the present invention will be described. However, the scope of the invention is not limited to the disclosed embodiments. In this connection, in the description for the drawings, the same element is provided with the same reference symbol, and the overlapping description is omitted. Moreover, dimensional ratios in the drawings are exaggerated on account of description, and, may be different from the actual ratios.

FIG. 1 is a drawing showing a schematic configuration of an image forming apparatus according to the present embodiment. As shown in FIG. 1, an image forming apparatus 1 includes a processor 10, an operation panel 20, an image forming unit 30, and a sheet feed conveyor 40.

The processor 10 includes a central processing unit (CPU) and a memory, and the CPU executes a control program stored in the memory, thereby performing various kinds of control of the entire image forming apparatus 1.

The operation panel 20 includes a touch panel, a numeric keypad, a start button, a stop button, etc., and is used for inputting various settings with regard to an apparatus, displaying the state of the apparatus, and inputting various instructions.

(Image Forming Unit 30)

The image forming unit 30 includes image formers 31, an intermediate transfer belt 32, a cleaning device 33 for this intermediate transfer belt 32, a secondary transferrer 34, a cleaning device 35 for this secondary transferrer 34, and a fixing device 36.

Each of the image formers 31 includes a configuration corresponding to each of basic colors of yellow (Y), magenta (M), cyan (C), and black (K). The intermediate transfer belt 32 moves in a clockwise direction in the indication of the drawing (refer to an arrow mark). A line-up order of the image formers 31 of Y, M, C, and K is arranged such that the image former 31 for Y is disposed at the most upstream position and that the image formers 31 for M, C, and K are disposed at the second to fourth positions respectively.

Each of the image formers 31 includes a photoconductor drum, a charging electrode, an exposing unit, a developing unit, a cleaning unit, a primary transferrer, and the like. In the developing unit, two component developer is stored. Each of the image formers 31 differs in the color of the toner of the developer stored in the developing unit from the others. However, each of the image formers 31 has the same configuration except the color of the toner.

As mentioned above, the developing unit of each of the image formers 31 contains two-component developer composed of carrier particles and small-diameter toner particles of color of one of yellow, magenta, cyan, and black different from the colors of the other image formers 31. The two-component developer is composed of carrier particles each of which includes a ferrite particle as a core around which an insulating resin is coated and toner particles each of which contains polyester as a main material and into which coloring agents such as pigment or carbon black and external additives such as charge control agents, silica, titanium oxide are added. The carrier particle has a particle diameter of 15 to 100 μm and saturation magnetization of 10 to 80 emu/g, and the toner particle has a particle diameter of 3 to 15 μm and, a negative charging characteristic, and an average charge amount of −20 to −60 μC/g. As the two-component developer, used is one in which these carrier particles and toner particles are mixed such that the toner concentration becomes 4 to 10% by mass.

The intermediate transfer belt 32 that functions also as a toner carrying body is rotatably stretched by a plurality of rollers. As the intermediate transfer belt 32, for example, used is a semiconductor belt that is made of polyimide and has a volume resistivity set to 8 to 11 LOG Ω·cm and a thickness of 80 μm. The plurality of rollers that stretches the intermediate transfer belt 32 includes an opposing roller that forms a transfer nip between it and a later-mentioned secondary transferrer. This opposing roller r21 is composed of, for example, a nitrile rubber (NBR: Nitrile Butadiene Rubber) as a material and has a rubber hardness of 40 degrees (Asker-C) and a volume resistivity of 8 LOG Ω.

Toner images formed by the image formers 31 are transferred sequentially onto the surface of the intermediate transfer belt 32 by the respective primary transferrers so as to be superimposed on each other and, thereafter, are transferred onto a sheet S conveyed to a transfer position p1 (refer to later-mentioned FIG. 2). The secondary transferrer 34 comes in contact with the reverse surface of a sheet S at the transfer position p1 and makes a toner image transfer on an obverse surface of the sheet S. The sheet S on which a full color toner image has been transferred is conveyed to the fixing device 36 on the downstream side and is subjected to heating and pressurizing processes, whereby a full color image is formed on the sheet S.

Transfer residual toner that remains on the intermediate transfer belt 32 without being transferred to the sheet S is conveyed to the downstream side and is collected by the cleaning device 33 for the intermediate transfer belt 32. The cleaning device 33 includes a brush roller, a lubricant supplier, one or more cleaning blades, and a housing that accommodates these components. The transfer residual toner on the intermediate transfer belt 32 is cleaned by the cleaning blade. Moreover, onto the surface of the intermediate transfer belt 32, a lubricant material (lubricant agent) is coated by the lubricant supplier.

The sheet feed conveyor 40 includes a plurality of sheet feed trays 41 and sheet conveyance paths 42 and 43. Into the sheet feed tray 41, a plurality of sheets S is stacked, and the sheets S are fed out one by one from the uppermost position of the sheets S. The sheet feed conveyor 40 includes a plurality of conveyance roller pairs arranged along the sheet conveyance paths 42 and 43 and a drive motor (not shown) that drives these conveyance roller pairs and conveys a sheet S fed out from the sheet feed tray 41 to a transfer position of the secondary transferrer 34 and the fixing device 36 on the downstream side of the transfer position.

Moreover, in the case of performing both-sided printing, a sheet S on one side of which an image has been formed is conveyed to a sheet conveyance path 43 for the both sided printing located on the lower portion. The sheet S conveyed to this sheet conveyance path 43 is subjected to a reversing process on a switchback path so as to reverse the obverse and reverse surfaces, thereafter, joins the sheet conveyance path 42 for one sided printing again, and the sheet S is subjected to image formation again so as to form an image on the other side surface of the sheet S at the image former 30.

(Secondary Transferrer 34)

Figure 2:
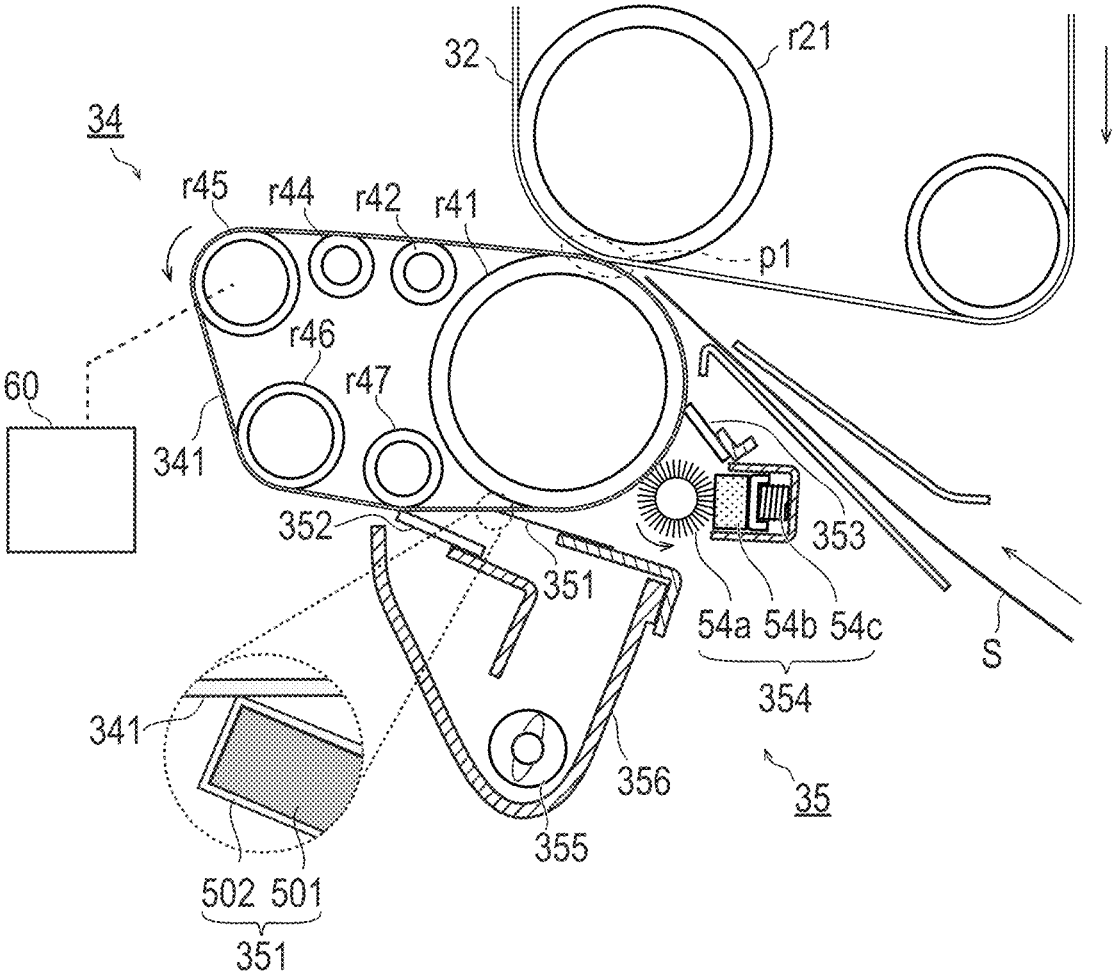
FIG. 2 is an illustration showing a configuration in the vicinity of a secondary transferrer and cleaning device.

FIG. 2 is an enlarged view of FIG. 1 and is an illustration showing a configuration in the vicinity of the secondary transferrer 34 and cleaning device 35. The secondary transferrer 34 and the cleaning device 35 can be replaced as one body as a secondary transfer unit. The secondary transferrer 34 includes an endless secondary transfer belt 341 as a transfer member and a plurality of rollers r41 to r47.

The secondary transfer belt 341 functions as a "toner carrying body". This secondary transfer belt 341 is rotatably stretched by the rollers r41 to r47 and moves counterclockwise in the indication of the illustration (refer to an arrow mark). As the secondary transfer belt 341, used is a resin belt that is made of polyimide as a material of and has a volume resistivity set to, for example, 10 LOG Ω·cm and a thickness of 100 μm.

The roller r41 functions as a secondary transfer roller. The roller r41 is pushed with a predetermined pressure of, for example, 70 N towards the opposing roller r21 disposed on the inner-peripheral-surface side of the intermediate transfer belt 32. The intermediate transfer belt 32 and the secondary transfer belt 341 are sandwiched between the roller r41 and the opposing roller r21 and forms a transfer nip at the transfer position p1. Moreover, at the time of transferring a toner image onto a sheet S, a predetermined voltage or current is applied to the roller r41 by a high voltage power source (not shown). The roller r41 is configured by making SUS as a material. The roller r41 and the opposing roller r21 have substantially the same outer diameter, and, for example, both of them have an outer diameter of 30 mm.

The roller r45 functions as a driving roller and is driven by a driver 60 that includes a stepping motor, a gear, and the like. The roller r46 functions as a steering roller and is connected to a steering mechanism (not shown). The steering mechanism includes a drive source, an actuator, and a detection sensor. The steering mechanism shifts (inclines) the position of at least one of the end portions of the roller r46 according to the end position of the secondary transfer belt 341 detected by the detection sensor. The steering mechanism makes the rotation axis of the roller r46 incline relative to the rotation axis of each of the other rollers r41, r45 etc., thereby controlling the travelling of the secondary transfer belt 341 and preventing meandering.

(Cleaning Device 35)

The cleaning device 35 includes a first blade 351, a second blade 352, a third blade 353 for pressing, a lubricant coater 354, a conveyance screw 355, and an accommodation case 356 and cleans the surface of the secondary transfer belt 341. For example, the first blade 351 (hereinafter, merely referred to a blade 351, and blades 352 and 353 are referred in the similar manner) is mainly composed of a rigid member, and the second blade 352 on its upstream side is mainly composed of an elastic member. Each of these blades 351, 352, and 353 is a thin plate-shaped member. The length of a shorter-size direction of them is about ten and several mm, and the length of a longer-size direction is a little longer than the overall width of a sheet and is, for example, 300 mm to 400 mm.

As shown in FIG. 2, by making the transfer position p1 as a reference position, the respective blades are disposed in the order of the blade 352, the blade 351, the lubricant coater 354, and the blade 353 from the upstream side in the movement direction of the secondary transfer belt 341 so as to come in contact with the surface of the secondary transfer belt 341.

(Second Blade 352)

The second blade 352 is composed of an elastic member, such as a rubber material. As the rubber material, a urethane rubber is preferably used. However, a fluorocarbon rubber, styrene-butadiene rubber, or nitrile rubber may be applied. The blade 352, for example, has a thickness of 2 mm and is held by a holder so as to come in contact with the secondary transfer belt 341 with a contact angle of 15 degrees and a contact pressure of 30 N/m. The blade 352 is, for example, a fixed system, and the holder is fixed to the accommodation case 356. A free length from the holder is 9 mm. The roller r47 that functions as an opposing roller is disposed inside the secondary transfer belt 341 so as to oppose the contact position of the blade 352. This roller r47, for example, is composed of metal, such as SUS and has an outside diameter of 12 mm.

(First Blade 351)

The first blade 351 is composed of a material harder than the second blade 352 as a whole. The blade 351 includes a substrate 501 and a coat layer 502. The coat layer 502 covers at least a contact region of the substrates 501. For example, the coat layer 502 covers a region of several mm (for example, a range of 2 mm from the tip) on the tip side that comes in contact with the toner carrying body. The substrate 501 is preferably a rigid body composed of metal and is more preferably a rigid body composed of SUS (especially SUS304). The blade 351, for example, has a thickness of 0.1 mm, is held by a holder fixed to the accommodation case 356 so as to come in contact with the secondary transfer belt 341 with a contact angle of 10 degrees and a contact pressure of 5 N/m, and has a design-based bite amount of 0.3 mm (for example, a fixed system). A free length from the holder is 10 mm.

The coat layer 502 is composed of a material harder than the material of the substrate 501. As the coat layer 502, there is a hard film of a BCN system, and a diamond-like carbon film (DLC: Diamond Like Carbon) is particularly preferable. The film thickness of the coat layer 502 can be set, for example, within a range of 0.01 to 10 μm. By providing such a hard coat layer 502 on a tip edge of the substrate 501 of the blade 351, it is possible to suppress wear of the tip and to secure a cleaning performance stable in durability.

Moreover, there is not provided a roller that opposes a contact position of the blade 351. That is, the contact position of the blade 351 is positioned on a region where neither of the rollers is disposed inside the secondary transfer belt 341. By doing in this way, in the case where the contact pressure between the secondary transfer belt 341 and the hard blade 351 suddenly increases excessively, the secondary transfer belt 341 is allowed to evacuate inside (pushes down). With this, it becomes possible to prevent the secondary transfer belt 341 from being damaged and causing scratches on its surface. Moreover, in the case where if a roller is disposed inside the secondary transfer belt 341 at the contact position of the blade 351, when foreign substances adhere to this roller or the back surface of the secondary transfer belt 341, the secondary transfer belt 341 rises on the roller. At this time, a hard blade 351 cannot absorb the risen portion, which causes a problem that toner passes through both sides of the risen portion. The configuration executed in the present embodiment can prevent such a problem.

The third blade 353 is a fixing blade that flattens lubricant supplied from a later-mentioned lubricant coater 354 onto the secondary transfer belt 341 and presses the lubricant onto the surface. As shown in FIG. 2, each of the first blade 351 and the second blade 352 comes in contact with the secondary transfer belt 341 in a counter system in which its tip faces the upstream side of the movement direction of the secondary transfer belt 341. On the other hand, this third blade 353 is held by a holder so as to come in contact with the secondary transfer belt 341 in a trail system in which its tip faces the downstream side. The third blade 353 comes in contact with the secondary transfer belt 341 with, for example, a thickness of 1.6 mm and a contact angle of 51 degrees. A design-based bite amount is 0.3 mm. A free length from the holder is 6 mm.

The lubricant coater 354 includes a brush roller 54*a*, a solid lubricant 54*b*, and a supporter 54*c*. One end of the supporter 54*c* is fixed to a housing. The solid lubricant 54*b* is one that is formed by solidifying molten lubricant powder in the shape of an approximately rectangular parallelepiped and, for example, has a height of 4.5 mm, a depth of 8 mm, and a width of 8 mm. As a lubricant used in the solid lubricant 54*b*, selected is a material that can be coated onto the surface of the secondary transfer belt 341 and, by lowering the surface energy of the surface, can reduce an adhesion force between adhesive materials such as toner and the secondary transfer belt 341. For example, examples of the lubricant include a fatty acid metal salt, a fluorine resin, and the like, and these can be used solely or by being mixed in combination of two or more. In particular, the fatty acid metal salt is preferable. As the fatty acid metal salt, as the fatty acid, a linear hydrocarbon is preferable, for example, myristic acid, palmitic acid, stearic acid, oleic acid, etc. are preferable, and stearic acid is more preferable. As the metal, lithium, magnesium, calcium, strontium, zinc, cadmium, aluminum, cerium, titanium, iron, etc. are listed. Among these, zinc stearate, magnesium stearate, aluminum stearate, iron stearate, and the like are preferable, and, in particular, zinc stearate is the most preferable.

The supporter 54*c* includes a holder to hold the solid lubricant 54*b* and an elastic body, such as a coil spring and presses (bring in contact with) the solid lubricant 54*b* onto the brush roller 54*a* with a predetermined pressing force via the holder. The amount of bite of the brush roller 54*a* onto the secondary transfer belt 341 is, for example, 0.5 mm, and the pressing force at this time is 1 N. The brush roller 54*a* is one in which brush fiber is implanted onto or wound around a core metal with an outside diameter of 6 mm, and an overall outer diameter is 12 mm. This brush fiber is composed of, for example a polyester material with a pile diameter of 4 d and a pile density of 150 KF/inch$^2$ and has a resistance of an order of $10^{12}\Omega$. The brush roller 54*a* is rotatably driven in a counter direction to the movement direction of the secondary transfer belt 341 by a driver (not shown). By the rotatably driving, the brush roller 54*a* scrapes lubricant (lubricant powder) off from the solid lubricant 54*b* and coats this to the surface of the secondary transfer belt 341.

Toner and external additive scraped off from the secondary transfer belt 341 with the blades 351 and 352 fall downward along an inner surface of the accommodation case 356 that covers the blades 351 and 352. On a lower portion of the accommodation case 356, there is provided a conveyance screw 355. The fallen toner etc. are conveyed by the conveyance screw 355 to the back side of the apparatus main body and are collected in a recovering box disposed on the back side.

FIG. 3 is a table showing an example of a designed value of each structural member described up to the above.

(Cross-sectional shape, in thickness direction, of tip portion of each of blade 351 and substrate 501) Next, with reference to FIG. 4 to FIG. 10, described is a preferable example of a cross-sectional shape, in the thickness direction, of the tip portion of the substrate 501.

Figure 4:
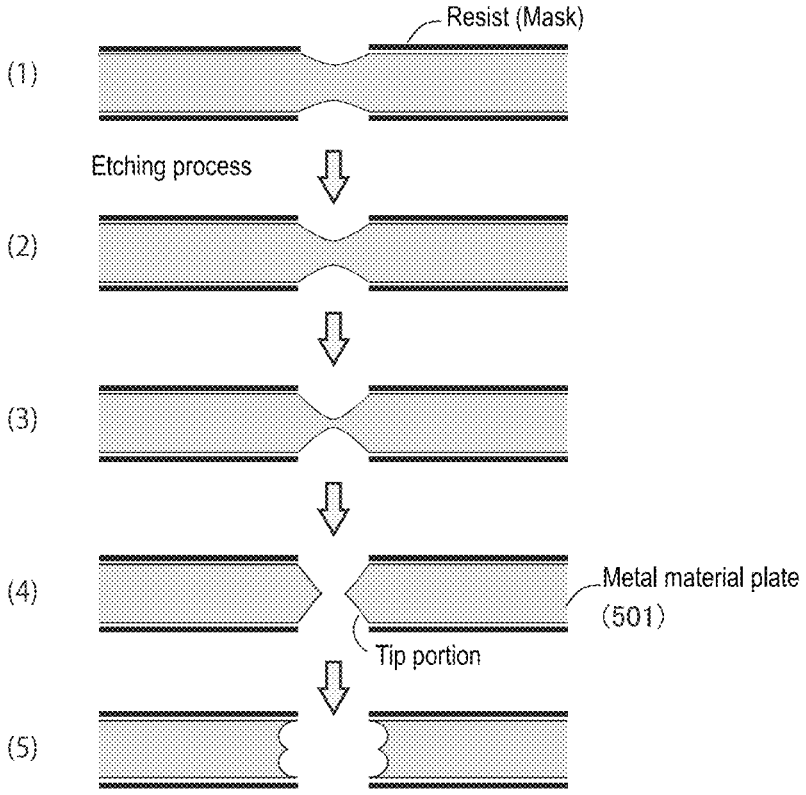
FIG. 4 is a schematic illustration showing a forming procedure of a tip of a blade.

FIG. 4 is a schematic illustration showing a forming procedure of a tip of a blade. In the present embodiment, a resist pattern (mask) is formed on the surface of a metal material plate such as SUS etc. and an etching process (both-sided etching process) is performed from both of the obverse and reverse surfaces with a resist liquid, whereby a tip is formed. In (1) to (5) of FIG. 4, respective etching depths in time series according to processing time are shown. In (1), the processing time is the shortest and the etching depth is shallow. In (5), the processing time is the longest, and the etching depth is deep. Moreover, in FIG. 4, the both-sided etching process is shown as an example. In (4) of FIG. 4, the tip portion is shaped in the thickness direction such that a center side protrudes more than end portions, i.e., a cross-sectional shape in the thickness direction is a convex shape.

Figure 5:
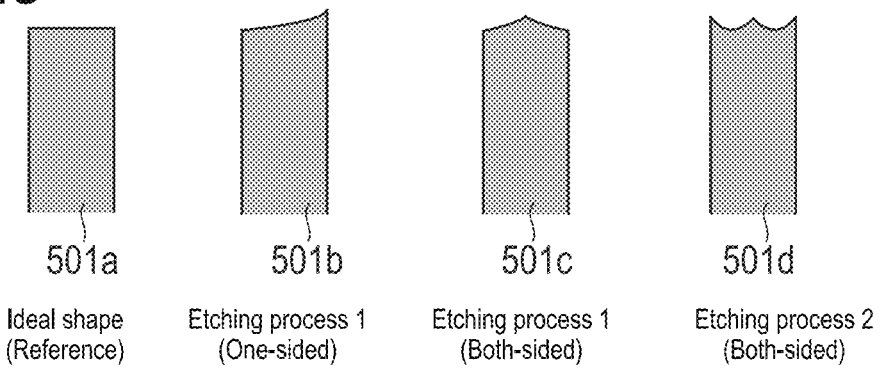
FIG. 5 is an illustration showing a shape of a substrate formed by an etching process.

FIG. 5 is an illustration showing the respective shapes of the substrates 501*a* to 501*d* formed by the etching process. In FIG. 5, the cross-sectional shape seen from the longer-size direction (axial direction of each roller) is shown (in FIG. 6 to FIG. 10, the cross-sectional shape is shown also in the same manner).

The substrate 501*a* has an ideal shape in which the edge angle (hereafter, merely referred to as an "edge angle"), in the thickness direction, of the tip portion is 90 degrees. However, this ideal shape is difficult to actually manufacture. The substrate 501*b* is formed by a one-sided etching process (Etching process 1), the substrate 501*c* is formed by a both-sided etching process (Etching process 2), and the processing time of each of them corresponds to (4) of FIG. 4. In the substrate 501*b*, the left side is the processed-surface side in the etching process. The substrate 501*d* is formed by a both-sided etching process (Etching process 3), and the processing time corresponds to (5) of FIG. 4.

Figure 6:
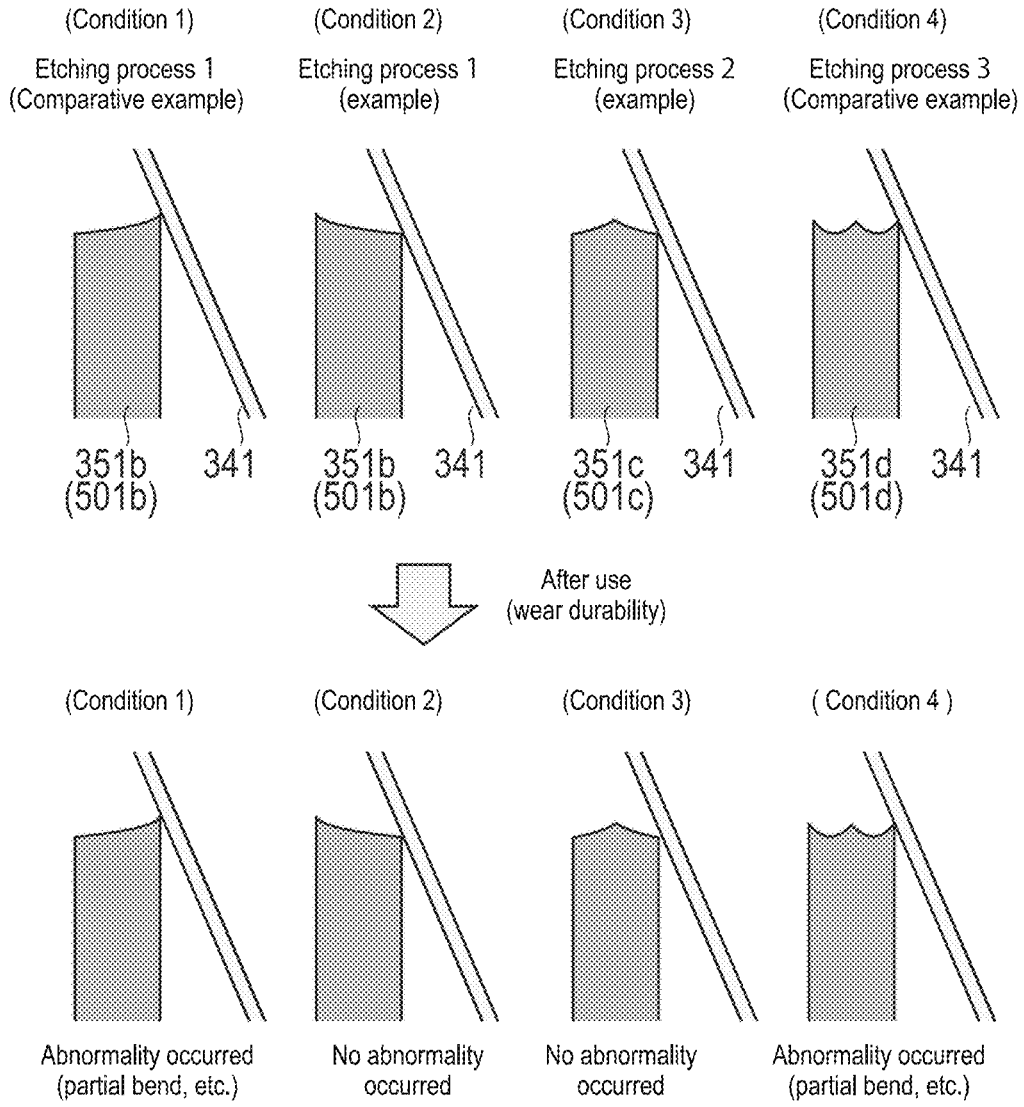
FIG. 6 is a schematic illustration showing a cross-sectional shape of a tip of a blade and a variation, with elapsed time, of an edge due to use.

FIG. 6 is a schematic illustration showing the contact surface of the tip of each of the blades 351 produced in the respective substrates 501*b* to 501*d* and a variation, with elapsed time, of an edge due to use. The substrate of the blades 351*b* to 351*d* correspond to the substrates 501*b* to 501*d* shown in FIG. 4 respectively, and the blades 351*b* to 351*d* are formed by forming the coat layer 502 onto the respective substrates 501*b* to 501*d*. In this connection, on Condition 1 and Condition 2, although the respective orientations of the contact surfaces differ from each other, the same blade 351*b* is used. On this Condition 2, the processed-surface side of the one-sided etching process is made to come in contact, and on Condition 1, a side not being the processed-surface side is made to come in contact.

Here, on Condition 2, in the substrate 501*b* of the blade 351*b*, the cross-sectional shape, in the thickness direction, of the tip portion is a protruding shape in which the center side protrudes more than the end portion of the contact side. Moreover, on Condition 3, in the substrate 501*c* of the blade 351*c*, the cross-sectional shape, in the thickness direction, of the tip portion is the convex shape and the protruding shape in which the center side protrudes more than the end portion of the contact side.

These blades were caused to frictionally slide on the travelling secondary transfer belt 341 for a predetermined time (predetermined distance) corresponding to a use period (exchange cycle), and thereafter, the state of the edge having deteriorated with elapsed time and its performance were evaluated.

As a result, in the evaluation on Conditions 2 and 3, the abnormalities of the edge did not occur, and the good cleaning performance was maintained. However, on Conditions 1 and 4, the abnormalities of the edge occurred, and the lowering of the cleaning performance was observed.

Figure 7:
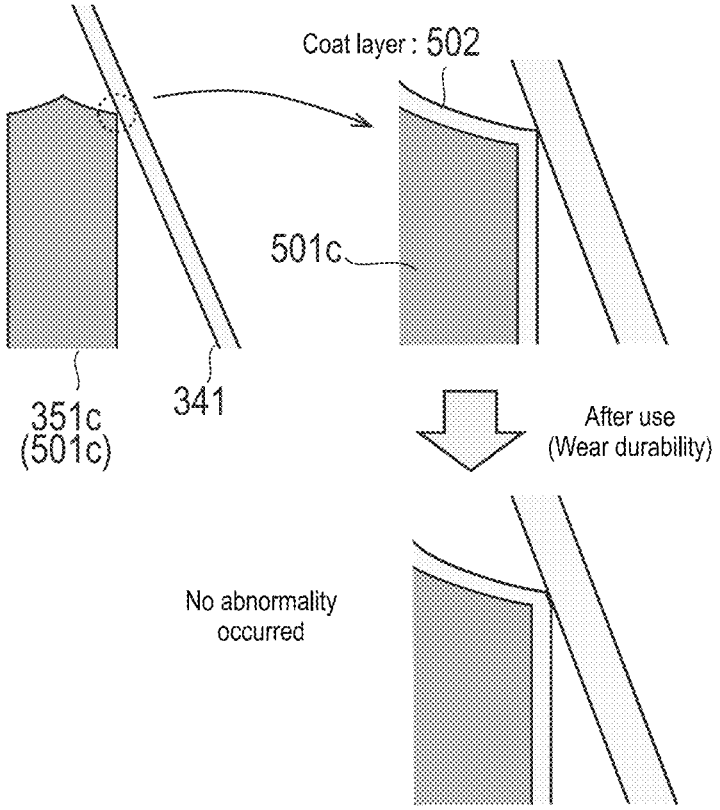
FIG. 7 is a schematic illustration for describing a deterioration, with elapsed time, of an edge due to use on Condition 3 in FIG. 6.
Figure 8:
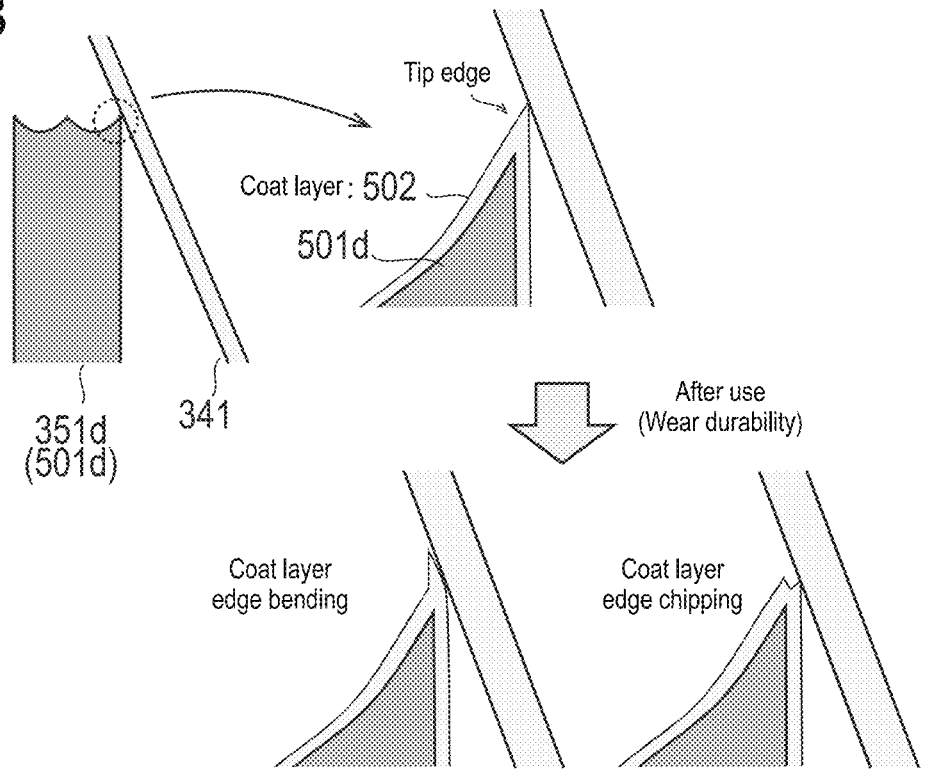
FIG. 8 is a schematic illustration for describing a deterioration, with elapsed time, of an edge due to use on Condition 4 in FIG. 6.

FIG. 7 and FIG. 8 are schematic illustrations for describing the deterioration, with elapsed time, of the edge due to use. FIG. 7 and FIG. 8 correspond to Conditions 3 and 4 in FIG. 6, respectively.

As shown in FIG. 7, on Condition 3 in which the blade 351*c* was used, even after the use, on the coat layer 502, only the usually expected wear has occurred, and abnormalities did not occur.

On the other hand, on Conditions 4 in which the blade 351*d* shown in FIG. 8 was used, abnormalities occurred due to unexpected phenomenon, such as bending or chipping of the coat layer 502. On a portion where the abnormalities occurred, the following problems may occur. Since toner and the like cannot be scraped off, slipping-through (or passing-through) occurs. Since the passed-through toner accumulates over a long period, the toner may stick onto the surface of the toner carrying body. In the blade 351*d*, the acute angle of the tip edge of the substrate 501*d* is too sharp. Therefore, on the tip edge of the blade 351*d*, only the coating material of the coat layer 502 becomes to exist. In this case, only the coating material comes in contact with the toner carrying body (secondary transfer belt 341) and becomes a state of frictionally sliding. Due to such a matter, as shown in FIG. 8, in the tip edge portion, an unexpected phenomenon such as bending or chipping will occur. In this connection, although illustration is omitted, also, on Condition 1 in which the blade 351*b* was used, the similar phenomenon occurred.

(Proper Range of Angle of Tip Edge Portion)

FIG. 9A is a schematic drawing showing an edge angle θa of a tip portion, and FIG. 9B is a table of an evaluation result showing a proper range of the edge-angle θa. An angle θb is a contact angle of the blade 351 relative to the secondary transfer belt 341. Here, as the edge angle θa, used is an angle near a contact point between the blade 351 and the toner carrying body (secondary transfer belt 341).

A proper range exists in the tip edge angle θa on the contact-surface side of the tip. If the edge angle θa is too small, as mentioned above, chipping or bending of the coat layer 502 will occur. On the other hand, if the edge angle θa is too large, since an angle (=180−(θa+θb)) with the toner carrying body becomes small, toner etc. scraped off from the secondary transfer belt 341 by the blade 351 are not discharged efficiently and become easy to accumulate in a stay region on the upstream side of the contact position of the blade 351. In this case, the toner etc. on the stay region are compressed and cause slipping-through (hereafter, referred to "toner compressed-contact slipping-through".

In FIG. 9B, by making the processing time of the etching process differ, a plurality of blades 351 with the respective different edge angles θa were prepared, and then, in each of these blades 351, evaluated was the occurrence situation of problems such as toner compressed-contact slipping-through or chipping or bending of the tip. A situation where no problem occurred, is indicated with a symbol "A", a situation where problems with an impermissible level occurred, is indicated with a symbol "C", and a situation where minor problems with a permissible level intermediate between "A" and "C" occurred, is indicated with a symbol "B".

As shown in the table in FIG. 9B, the chipping or bending of the tip is made permissible in a range of the edge angle θa of 60 degrees or more, and the toner compressed-contact slipping-through is made permissible in a range of the edge angle θa of 140 degrees or less. Therefore, a preferable range of the edge angle θa is 60 degrees to 140 degrees. Moreover, a more preferable range is 70 degrees to 130 degrees, because all items become "A" level in this range.

(Shape with Consideration of Durability)

Even if the edge angles θa is made to be in the preferable range, since the wear of the blade 351 advances due to a deterioration with elapsed time, it is necessary to exchange the blade 351 for every predetermined period (for example, every one million prints). In the case of using a blade in which a tip portion has a convex shape as being like the blade 351*c* (refer to FIG. 6), even if a contact surface of one side has been worn out and has become unable to be used, the blade can be reused by reversing the obverse and reverse surfaces by a service staff and attaching the blade again so as to make the surface of other side come in contact.

Therefore, in the viewpoint of durability in the case of including the using of both the obverse and reverse surfaces by reattaching the blade, the blade 351*c* in which the cross-sectional shape, in the thickness direction, of a tip portion is the convex shape, is preferable than the blade 351*b* with the protruding shape (is not the convex shape). Moreover, in the convex shape, as shown in FIG. 10, it is preferable that a ratio of a protruding length h1 of a protrusion on the center side to a thickness w1 of the blade 351 is 40% or less. This ratio of 40% corresponds to an edge angle θa of 140 degrees. That is, by forming the substrate 501 with the both-sided etching process and by making the etching processing time to be in a proper range (corresponding to (4) of FIG. 4), it is possible to make the cross-sectional shape of the substrate 501 to the convex shape (h1>0, h1/w1<0.4) with a proper protruding amount.

In this way, in the present embodiment, the cross-sectional shape, in the thickness direction, of the tip portion of the blade 351 is made a convex shape or a protruding shape in which a center side protrudes than an edge portion of a contact side, whereby it is possible to prevent bending or chipped edge in the coat layer 522 and, eventually, to secure the durably stable cleaning performance of the cleaning device 35. With this, it is possible to provide the cleaning device with improved durability. In particular, by forming the substrate 501 through the etching process with proper processing time, it is possible to obtain the blade 351 having such a cross-sectional shape.

With regard to the respective configurations of the above-described cleaning device 35 and image forming apparatus 1, in describing the features of the above-described embodiment, their main configurations have been described. Accordingly, without being limited to the above-described configurations, it is possible to make various modifications within the scope of claims. Moreover, it is not intended to exclude a configuration equipped a general cleaning device or image forming apparatus. For example, in the above-described configuration, described has been an example where the intermediate transfer belt functions as an image carrying body, the secondary transfer belt 341 functions as a toner carrying body, and the present invention is applied to the cleaning device 35 for the secondary transfer belt 341. However, without being limited to the above configuration, a photoconductor drum is made to function as the image carrying body, the intermediate transfer belt 32 is made to function as the toner carrying body, and then, and the present invention may be applied to the cleaning device 33 for the intermediate transfer belt 32. Moreover, as the toner carrying body, instead of the endless belt such as the secondary transfer belt and the intermediate transfer belt, the toner carrying body may be one in which a surface layer of an elastic body is formed on a drum-shaped rigid body.

Although embodiments of the present invention have been described and illustrated in detail, the disclosed embodiments are made for purpose of illustration and example only and not limitation. The scope of the present invention should be interpreted by terms of the appended claims.

What is claimed is:

1. A cleaning device, comprising:

a thin plate-shaped first blade that makes a tip portion come in contact with a toner carrying body used to carry toner, thereby cleaning a surface of the toner carrying body, wherein the first blade includes a substrate and a coat layer covering a surface of the substrate; and in the first blade, a cross-sectional shape, in a thickness direction, of the tip portion is a convex shape in which a center side of the convex shape protrudes more than an end portion of a contact side, and wherein a ratio of a protruding length of the center side to a thickness of the blade is 0.4 or less.

2. The cleaning device according to claim 1, wherein the substrate of the first blade is composed of metal.

3. The cleaning device according to claim 2, wherein the tip portion of the first blade is formed by performing an etching process for the substrate, and the coat layer is formed by performing a coating process for the substrate after having been subjected to the etching process.

4. The cleaning device according to claim 1, wherein furthermore, the coat layer is provided on a contact region relative to the toner carrying body.

5. The cleaning device according to claim 1, wherein the coat layer is composed of a material with a hardness higher than a material of the substrate.

6. The cleaning device according to claim 5, wherein the coat layer is a diamond-like carbon film.

7. The cleaning device according to claim 1, wherein in a cross-sectional shape of the tip portion of the first blade, an edge portion coming in contact with the toner carrying body has an angle with a range of 60 degrees to 140 degrees.

8. The cleaning device according to claim 1, further comprising:

a second blade, disposed on an upstream side of the first blade in a movement direction of the toner carrying body, that comes in contact with a surface of the toner carrying body and is composed of an elastic material.

9. An image forming apparatus, comprising:

an image former that forms a toner image on an image carrying body;

the cleaning device according to claim 1 that cleans the surface of the toner carrying body; and the toner carrying body that transfers the toner image onto an obverse surface of a sheet by coming in contact with a reverse surface side of the sheet at a transfer position, or onto a surface of which the toner image is transferred at the transfer position.

* * * * *